US011419369B1

(12) United States Patent
Duke

(10) Patent No.: US 11,419,369 B1
(45) Date of Patent: Aug. 23, 2022

(54) INSECT PROTECTIVE GARMENT SYSTEM

(71) Applicant: Michael Duke, Paoli, IN (US)

(72) Inventor: Michael Duke, Paoli, IN (US)

( * ) Notice: Subject to any disclaimer, the term of this patent is extended or adjusted under 35 U.S.C. 154(b) by 1192 days.

(21) Appl. No.: 15/926,008

(22) Filed: Mar. 20, 2018

(51) Int. Cl.
*A41D 13/00* (2006.01)
*A41D 31/24* (2019.01)

(52) U.S. Cl.
CPC ..... *A41D 13/001* (2013.01); *A41D 31/245* (2019.02); *A41D 2300/50* (2013.01); *A41D 2500/10* (2013.01); *A41D 2500/20* (2013.01)

(58) Field of Classification Search
CPC ..... A41D 13/001; A41D 13/0015; A41D 2500/10; A41D 2600/14; A41D 2600/104
See application file for complete search history.

(56) References Cited

U.S. PATENT DOCUMENTS 3,783,451 A 1/1974 Malin
4,220,299 A * 9/1980 Motter ..... B64D 10/00 2/250
4,422,184 A * 12/1983 Myers ..... A41D 13/001 2/4
4,716,594 A * 1/1988 Shannon ..... A41D 13/001 2/4
4,979,236 A * 12/1990 Merrill ..... A01K 55/00 2/202
4,985,933 A * 1/1991 Lemoine ..... A41D 13/001 2/4
5,052,053 A * 10/1991 Peart ..... A41D 31/065 2/2.16
5,091,993 A * 3/1992 Merrill ..... A01K 55/00 2/202
5,119,510 A 6/1992 Schilling
5,249,307 A * 10/1993 Lemoine ..... A41D 13/001 2/4
5,343,564 A * 9/1994 Reynolds ..... A41D 13/001 2/236
5,535,447 A * 7/1996 Stevens ..... A41D 13/001 2/4
5,600,850 A * 2/1997 Shannon ..... A41D 13/001 2/4
6,263,511 B1 * 7/2001 Moretti ..... A41D 31/102 2/97
6,427,620 B1 * 8/2002 Crawford ..... A41D 1/04 114/347
7,243,375 B2 * 7/2007 Seo ..... A41D 13/001 2/69

(Continued)

*Primary Examiner* — Richale L Quinn
(74) *Attorney, Agent, or Firm* — Kyle A. Fletcher, Esq.

(57) ABSTRACT

The insect protective garment system is formed as an elastic mesh structure. The elastic mesh structure of the insect protective garment system forms a fluid permeable barrier around a wearer. The elastic mesh structure of the insect protective garment system forms a barrier structure that prevents an insect from directly contacting the skin of the wearer. The insect protective garment system comprises a plurality of tubular textiles, a plurality of gussets, a plurality of gusset seams, a plurality of seams, a plurality of openings, and a plurality of slits. The plurality of slits are cut in the plurality of tubular textiles. The plurality of openings are formed in the plurality of tubular textiles. The plurality of gussets, the plurality of gusset seams, and the plurality of seams assemble the plurality of tubular textiles into a shirt, pants, and a hood that protect the wearer from an insect.

15 Claims, 3 Drawing Sheets

(56) References Cited

U.S. PATENT DOCUMENTS

| | | | | |
|---|---|---|---|---|
| 7,636,955 | B2 * | 12/2009 | Plut | A41D 13/002 2/457 |
| D705,520 | S | 5/2014 | Harris | |
| D767,827 | S | 9/2016 | Workman | |
| 10,694,793 | B2 * | 6/2020 | West | A41B 9/08 |
| 10,905,177 | B2 * | 2/2021 | Iriarte Tineo | A41D 13/001 |
| 11,129,428 | B2 * | 9/2021 | Marchetto | A41D 31/00 |
| 2006/0048291 | A1 * | 3/2006 | Sims | A41D 13/001 2/456 |
| 2006/0085889 | A1 * | 4/2006 | Okajima | A41D 13/0015 2/77 |
| 2006/0230490 | A1 * | 10/2006 | Okajima | A41D 13/0015 2/77 |
| 2007/0271671 | A1 * | 11/2007 | Okajima | A41D 1/04 2/69 |
| 2008/0047046 | A1 * | 2/2008 | Maier | A41D 13/0007 2/102 |
| 2009/0158491 | A1 * | 6/2009 | Maier | A41D 13/02 2/78.1 |
| 2010/0306906 | A1 * | 12/2010 | Hunt | A41D 13/001 2/456 |
| 2012/0304359 | A1 * | 12/2012 | Bybee | A41D 13/0015 2/79 |
| 2013/0130874 | A1 * | 5/2013 | Richardson | A63B 23/0405 482/124 |
| 2013/0198926 | A1 * | 8/2013 | Rod, III | A41D 31/18 2/79 |
| 2015/0351466 | A1 * | 12/2015 | Asnis | A41D 13/0015 2/69 |
| 2016/0219947 | A1 * | 8/2016 | Nhim | A41D 31/00 |
| 2017/0027248 | A1 * | 2/2017 | McFarlane | A41H 1/00 |
| 2017/0208882 | A1 * | 7/2017 | Lambertz | B29C 39/36 |
| 2019/0309450 | A1 * | 10/2019 | Gretton | A41D 13/0015 |

* cited by examiner

INSECT PROTECTIVE GARMENT SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of personal and domestic articles including protective garments, more specifically, details of protective garments not otherwise provided for.

SUMMARY OF INVENTION

The insect protective garment system is a protective garment kit. The insect protective garment system is donned by a wearer. The insect protective garment system is formed as an elastic mesh structure. The elastic mesh structure of the insect protective garment system forms a fluid permeable barrier around the wearer. The elastic mesh structure of the insect protective garment system forms a barrier structure around the wearer that prevents an insect from directly contacting the skin of the wearer. The insect protective garment system comprises a plurality of tubular textiles, a plurality of gussets, a plurality of gusset seams, a plurality of seams, a plurality of openings, and a plurality of slits. The plurality of slits are cut in the plurality of tubular textiles. The plurality of openings are formed in the plurality of tubular textiles. The plurality of gussets, the plurality of gusset seams, and the plurality of seams assemble the plurality of tubular textiles into a shirt, a pair of pants, and a hood that protect the wearer from an insect.

These together with additional objects, features and advantages of the insect protective garment system will be readily apparent to those of ordinary skill in the art upon reading the following detailed description of the presently preferred, but nonetheless illustrative, embodiments when taken in conjunction with the accompanying drawings.

In this respect, before explaining the current embodiments of the insect protective garment system in detail, it is to be understood that the insect protective garment system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the insect protective garment system.

It is therefore important that the claims be regarded as including such equivalent construction insofar as they do not depart from the spirit and scope of the insect protective garment system. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
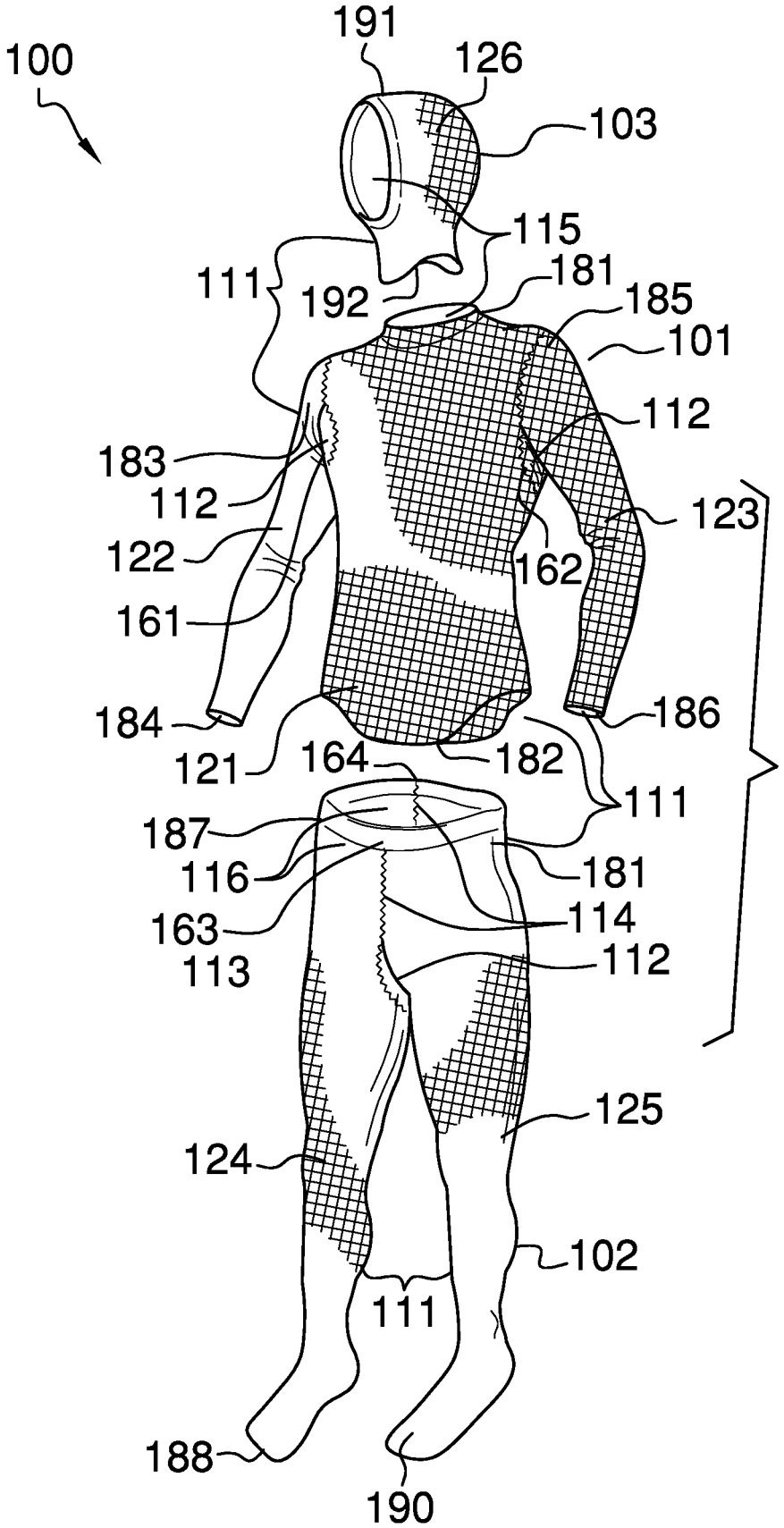
FIG. 1 is a perspective view of an embodiment of the disclosure.
Figure 2:
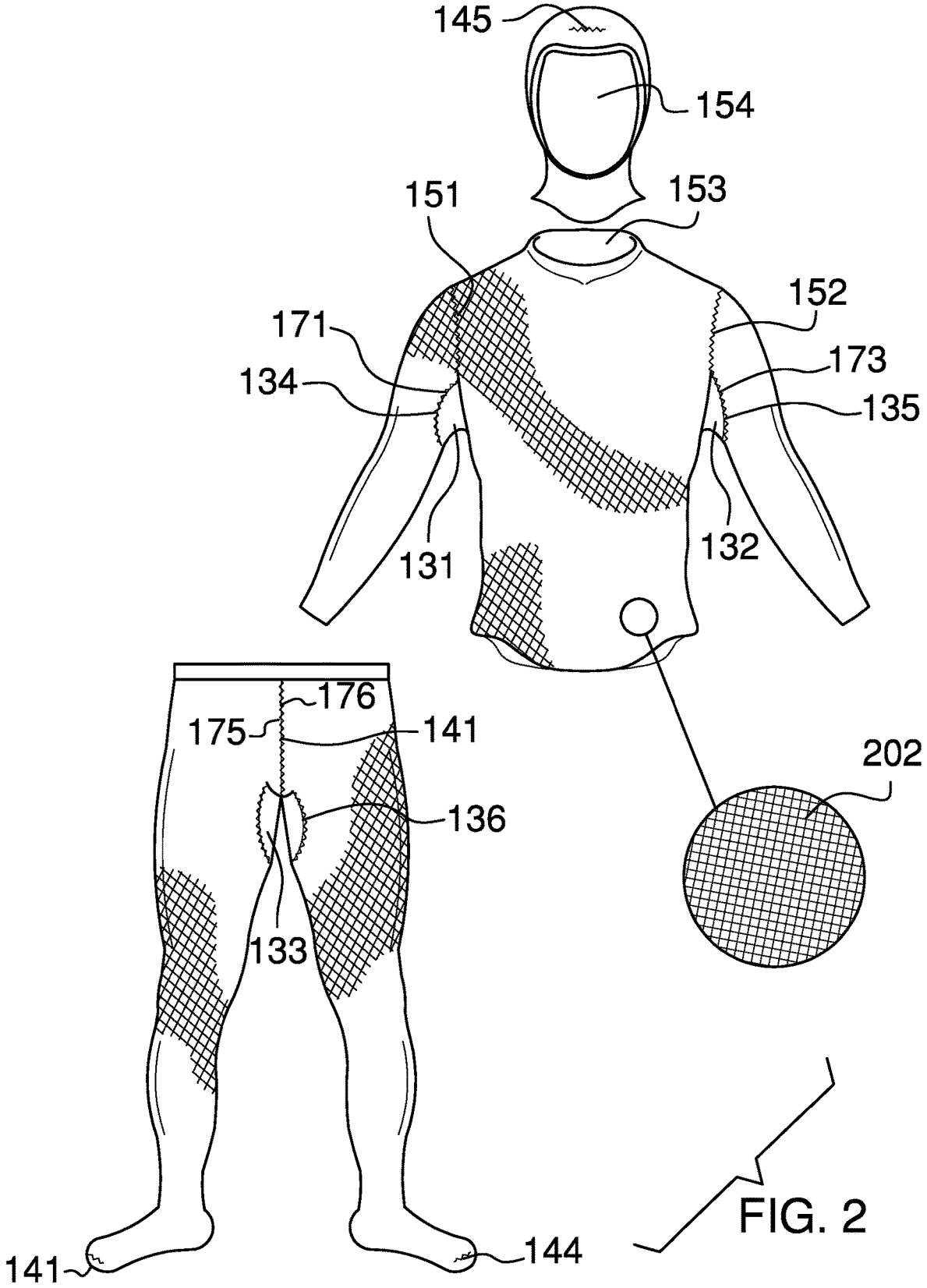
FIG. 2 is a front view of an embodiment of the disclosure.
Figure 3:
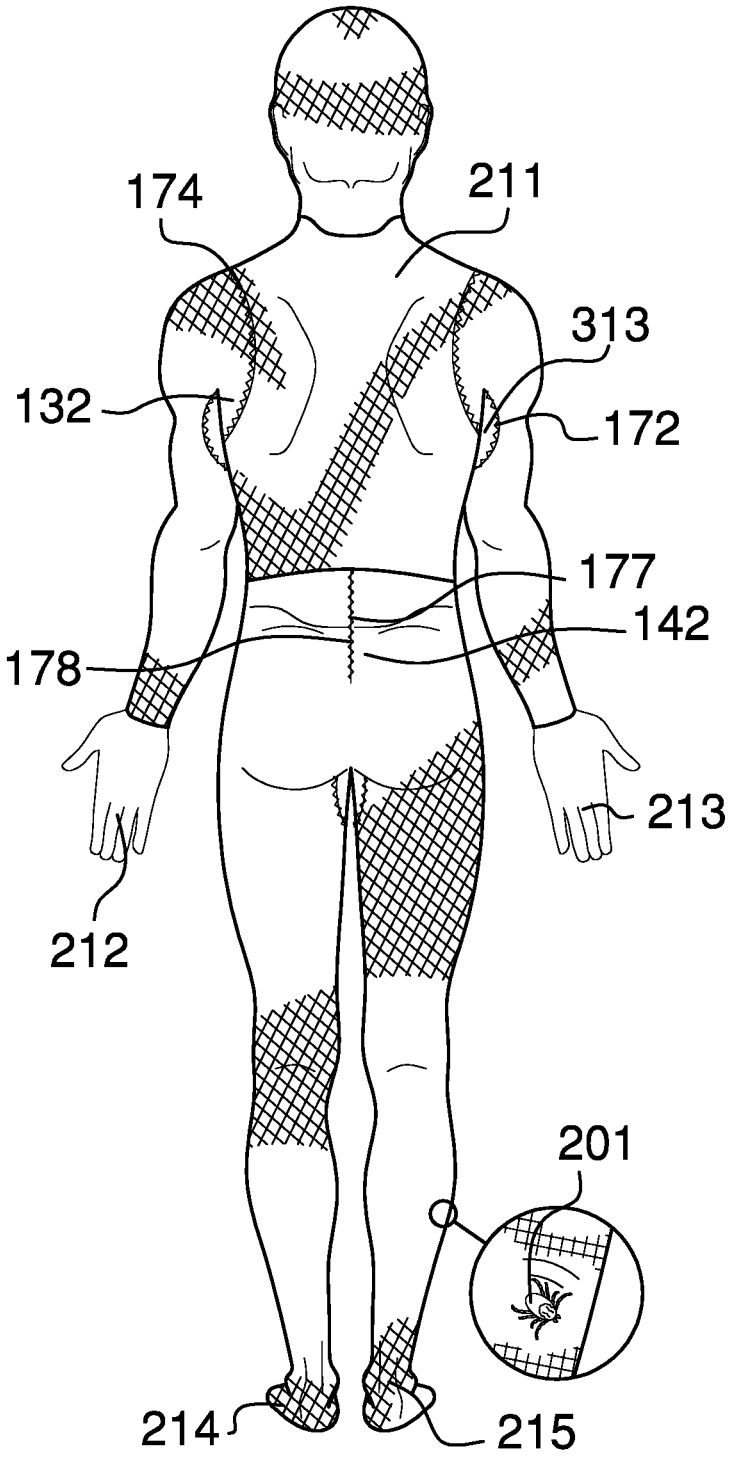
FIG. 3 is a rear view of an embodiment of the disclosure.
Figure 4:
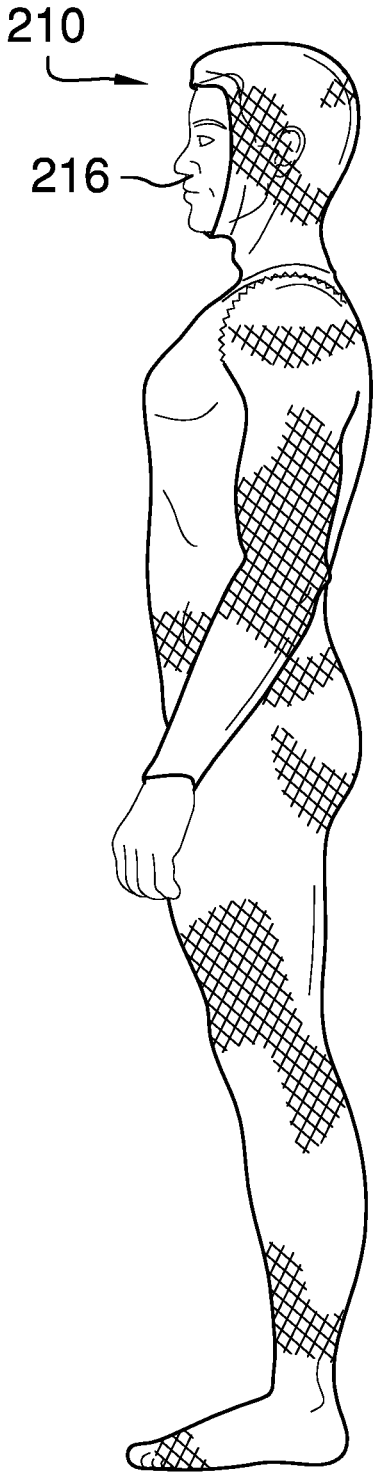
FIG. 4 is a side view of an embodiment of the disclosure.

Detailed reference will now be made to one or more potential embodiments of the disclosure, which are illustrated in FIGS. 1 through 4.

The insect protective garment system 100 (hereinafter invention) is a protective garment kit. The invention 100 is donned by a wearer 210 as personal protective equipment. The wearer 210 is further defined with a torso 211, a left arm 212, a right arm 213, a left leg 214, a right leg 215, and a head 216. The invention 100 is formed as an elastic mesh structure 202. The elastic mesh structure 202 of the invention 100 forms a fluid permeable barrier around the wearer 210. The elastic mesh structure 202 of the invention 100 forms a barrier structure around the wearer 210 that prevents an insect 201 from directly contacting the skin of the wearer 210.

The invention 100 comprises a plurality of tubular textiles 111, a plurality of gussets 112, a plurality of gusset seams 113, a plurality of seams 114, a plurality of openings 115, and a plurality of slits 116. The plurality of slits 116 are cut in the plurality of tubular textiles 111. The plurality of openings 115 are formed in the plurality of tubular textiles 111. The plurality of gussets 112, the plurality of gusset seams 113, and the plurality of seams 114 assemble the plurality of tubular textiles 111 into a shirt 101, a pair of pants 102, and a hood 103 that protect the wearer 210 from an insect 201.

The shirt 101, the pants 102, and the hood 103 are formed from the plurality of tubular textiles 111. The plurality of tubular textiles 111 are assembled into the invention 100 using the plurality of gussets 112, the plurality of gusset seams 113, the plurality of seams 114, and the plurality of slits 116. Each of the plurality of tubular textiles 111 is a commercially available tubular textile. In the first potential embodiment of the disclosure, each of the plurality of tubular textiles 111 is formed from an elastic mesh material 202.

The elastic mesh material 202 is a material commonly referred to as a hosiery textile. The elastic mesh material 202 is a textile mesh formed from both elastic and inelastic yarns. In the first potential embodiment of the disclosure, the elastic mesh material 202 is formed from elastic spandex yarns and inelastic yarns selected from the group consisting of nylon yarns and polyester yarns. The manufacture and use of hosiery textiles are well-known and documented in the textile and apparel arts.

The plurality of tubular textiles 111 comprises a first elastic tubular textile 121, a second elastic tubular textile 122, a third elastic tubular textile 123, a fourth elastic tubular textile 124, a fifth elastic tubular textile 125, and a sixth elastic tubular textile 126.

The first elastic tubular textile 121 is further defined with a first end 181 and a second end 182. The second elastic tubular textile 122 is further defined with a third end 183 and a fourth end 184. The third elastic tubular textile 123 is further defined with a fifth end 185 and a sixth end 186. The fourth elastic tubular textile 124 is further defined with a seventh end 187 and an eighth end 188. The fifth elastic tubular textile 125 is further defined with a ninth end 189 and a tenth end 190. The sixth elastic tubular textile 126 is further defined with an eleventh end 191 and a twelfth end 192.

The first elastic tubular textile 121 is a tubular elastic formed from a hosiery textile. The first elastic tubular textile 121 protects the torso 211 of the wearer 210 from an insect 201. The second elastic tubular textile 122 is a tubular elastic formed from a hosiery textile. The second elastic tubular textile 122 protects the right arm 213 of the wearer 210 from an insect 201. The third elastic tubular textile 123 is a tubular elastic formed from a hosiery textile. The third elastic tubular textile 123 protects the left arm 212 of the wearer 210 from an insect 201.

The first elastic tubular textile 121 acts as a spring. Specifically, when the torso 211 inserts into the first elastic tubular textile 121, a radial force is applied to the first elastic tubular textile 121 in a direction perpendicular to the center axis of the first elastic tubular textile 121. The applied radial force elongates the span of the diameter of the first elastic tubular textile 121 in the direction perpendicular to the center axis of the first elastic tubular textile 121. The elasticity of the first elastic tubular textile 121 creates a force that opposes the displacement created by the applied force. The elasticity of the first elastic tubular textile 121 returns the first elastic tubular textile 121 to its relaxed shape. The torso 211 will prevent the first elastic tubular textile 121 from returning to its relaxed shape. In this circumstance, the first elastic tubular textile 121 will apply a force projecting radially towards the center axis of the first elastic tubular textile 121 that binds first elastic tubular textile 121 to the torso 211.

The second elastic tubular textile 122 acts as a spring. Specifically, when the right arm 213 inserts into the second elastic tubular textile 122, a radial force is applied to the second elastic tubular textile 122 in a direction perpendicular to the center axis of the second elastic tubular textile 122. The applied radial force elongates the span of the diameter of the second elastic tubular textile 122 in the direction perpendicular to the center axis of the second elastic tubular textile 122. The elasticity of the second elastic tubular textile 122 creates a force that opposes the displacement created by the applied force. The elasticity of the second elastic tubular textile 122 returns the second elastic tubular textile 122 to its relaxed shape. The right arm 213 will prevent the second elastic tubular textile 122 from returning to its relaxed shape. In this circumstance, the second elastic tubular textile 122 will apply a force projecting radially towards the center axis of the second elastic tubular textile 122 that binds second elastic tubular textile 122 to the right arm 213.

The third elastic tubular textile 123 acts as a spring. Specifically, when the left arm 212 inserts into the third elastic tubular textile 123, a radial force is applied to the third elastic tubular textile 123 in a direction perpendicular to the center axis of the third elastic tubular textile 123. The applied radial force elongates the span of the diameter of the third elastic tubular textile 123 in the direction perpendicular to the center axis of the third elastic tubular textile 123. The elasticity of the third elastic tubular textile 123 creates a force that opposes the displacement created by the applied force. The elasticity of the third elastic tubular textile 123 returns the third elastic tubular textile 123 to its relaxed shape. The left arm 212 will prevent the third elastic tubular textile 123 from returning to its relaxed shape. In this circumstance, the third elastic tubular textile 123 will apply a force projecting radially towards the center axis of the third elastic tubular textile 123 that binds third elastic tubular textile 123 to the left arm 212.

The fourth elastic tubular textile 124 is a tubular elastic formed from a hosiery textile. The fourth elastic tubular textile 124 protects the right leg 215 of the wearer 210 from an insect 201. The fifth elastic tubular textile 125 is a tubular elastic formed from a hosiery textile. The fifth elastic tubular textile 125 protects the left leg 214 of the wearer 210 from an insect 201.

The fourth elastic tubular textile 124 acts as a spring. Specifically, when the right leg 215 inserts into the fourth elastic tubular textile 124, a radial force is applied to the fourth elastic tubular textile 124 in a direction perpendicular to the center axis of the fourth elastic tubular textile 124. The applied radial force elongates the span of the diameter of the fourth elastic tubular textile 124 in the direction perpendicular to the center axis of the fourth elastic tubular textile 124. The elasticity of the fourth elastic tubular textile 124 creates a force that opposes the displacement created by the applied force. The elasticity of the fourth elastic tubular textile 124 returns the fourth elastic tubular textile 124 to its relaxed shape. The right leg 215 will prevent the fourth elastic tubular textile 124 from returning to its relaxed shape. In this circumstance, the fourth elastic tubular textile 124 will apply a force projecting radially towards the center axis of the fourth elastic tubular textile that binds fourth elastic tubular textile 124 to the right leg 215.

The fifth elastic tubular textile 125 acts as a spring. Specifically, when the left leg 214 inserts into the fifth elastic tubular textile 125, a radial force is applied to the fifth elastic tubular textile 125 in a direction perpendicular to the center axis of the fifth elastic tubular textile 125. The applied radial force elongates the span of the diameter of the fifth elastic tubular textile 125 in the direction perpendicular to the center axis of the fifth elastic tubular textile 125. The elasticity of the fifth elastic tubular textile 125 creates a force that opposes the displacement created by the applied force. The elasticity of the fifth elastic tubular textile 125 returns the fifth elastic tubular textile 125 to its relaxed shape. The left leg 214 will prevent the fifth elastic tubular textile 125 from returning to its relaxed shape. In this circumstance, the fifth elastic tubular textile 125 will apply a force projecting radially towards the center axis of the fifth elastic tubular textile 125 that binds fifth elastic tubular textile 125 to the left leg 214.

The sixth elastic tubular textile 126 is a tubular elastic formed from a hosiery textile. The sixth elastic tubular textile 126 protects the head 216 of the wearer 210 from an insect 201.

The sixth elastic tubular textile 126 acts as a spring. Specifically, when the head 216 inserts into the sixth elastic tubular textile 126, a radial force is applied to the sixth elastic tubular textile 126 in a direction perpendicular to the center axis of the sixth elastic tubular textile 126. The applied radial force elongates the span of the diameter of the sixth elastic tubular textile 126 in the direction perpendicular to the center axis of the sixth elastic tubular textile 126. The elasticity of the sixth elastic tubular textile 126 creates a force that opposes the displacement created by the applied force. The elasticity of the sixth elastic tubular textile 126 returns the sixth elastic tubular textile 126 to its relaxed shape. The head 216 will prevent the sixth elastic tubular textile 126 from returning to its relaxed shape. In this circumstance, the sixth elastic tubular textile 126 will apply a force projecting radially towards the center axis of the sixth elastic tubular textile 126 that binds sixth elastic tubular textile 126 to the head 216.

Each of the plurality of gussets 112 is a textile material used to assemble elements of the invention 100. Each of the plurality of gussets 112 is used to widen a sub-plurality of gusset seams such that the range of motion of the wearer 210 is improved. The plurality of gussets 112 comprises a first gusset 131, a second gusset 132, and a third gusset 133.

The first gusset 131 is a textile material cut to a previously specified shape. The first gusset 131 is used in attaching the second elastic tubular textile 122 to the first elastic tubular textile 121 to form the shirt 101. The second gusset 132 is a textile material cut to a previously specified shape. The second gusset 132 is used in attaching the third elastic tubular textile 123 to the first elastic tubular textile 121 to form the shirt 101. The third gusset 133 is a textile material cut to a previously specified shape. The third gusset is used in attaching the fourth elastic tubular textile 124 to the fifth elastic tubular textile 125 to form the pants 102.

Each of the plurality of gusset seams 113 comprises a sub-plurality of sewn seams that, in conjunction with a gusset selected from the plurality of gussets 112, joins two tubular textiles selected from the plurality of tubular textiles 111. The plurality of gusset seams 113 comprises a first sub-plurality of gusset seams 134, a second sub-plurality of gusset seams 135, and a third sub-plurality of gusset seams 136.

The first sub-plurality of gusset seams 134 comprises a collection of sewn seams that, in combination with the first gusset 131 is used in attaching the second elastic tubular textile 122 to the first elastic tubular textile 121 to form the shirt 101. The second sub-plurality of gusset seams 135 comprises a collection of sewn seams that, in combination with the second gusset 132 is used in attaching the third elastic tubular textile 123 to the first elastic tubular textile 121 to form the shirt 101. The third sub-plurality of gusset seams 136 comprises a collection of sewn seams that, in combination with the third gusset 133 is used in attaching the fourth elastic tubular textile 124 to the fifth elastic tubular textile 125 to form the pants 102.

Each of the plurality of seams 114 is a sewn seam. Each of the plurality of seams 114 make an attachment selected from the group consisting of: 1) attaching a first tubular textile selected from the plurality of tubular textiles 111 to a second tubular textile selected from the plurality of tubular textiles 111; or, 2) closing the end of a tubular textile selected from the plurality of tubular textiles 111. The plurality of seams comprises a first seam 141, a second seam 142, a third seam 143, a fourth seam 144, and a fifth seam 145.

The first seam 141 is a seam used in the assembly of the pants 102. The second seam 142 is a seam used in the assembly of the pants 102. The third seam 143 is a seam used in the assembly of the pants 102. The fourth seam 144 is a seam used in the assembly of the pants 102. The fifth seam 145 is a seam used in the assembly of the hood 103.

Each of the plurality of openings 115 is an aperture formed in a tubular textile selected from the plurality of tubular textiles 111. Each of the plurality of openings 115 provide the apertures necessary to allow the wearer 210 to don and to use the invention 100. The plurality of openings 115 comprises a first arm opening 151, a second arm opening 152, a head opening 153, and a face opening 154.

The first arm opening 151 is an aperture in the first elastic tubular textile 121 that receives the right arm 213 of the wearer 210. The second arm opening 152 is an aperture in the first elastic tubular textile 121 that receives the left arm 212 of the wearer 210. The head opening 153 is an aperture in the first elastic tubular textile 121 that receives the head 216 of the wearer 210. The head opening 153 is formed at the first end 181 of the first elastic tubular textile 111. The face opening 154 is an aperture in the sixth elastic tubular textile 126 that provides visibility for the head 216 of the wearer 210.

Each of the plurality of slits 116 is a cut formed in a tubular textile selected from the plurality of tubular textiles 111. Each of the plurality of slits 116 starts at the edge of an end of a selected tubular textile. Each of the plurality of slits 116 has a termination point within the face of the selected tubular textile. Each of the plurality of slits 116 forms an edge that receives a seam selected from the group consisting of the plurality of gusset seams 113 and the plurality of seams 114.

The plurality of slits 116 comprises a first slit 161, a second slit 162, a third slit 163, and a fourth slit 164. The first slit 161 forms a first raw edge 171 and a second raw edge 172. The second slit 162 forms a third raw edge 173 and a fourth raw edge 174. The third slit 163 forms a fifth raw edge 175 and a sixth raw edge 176. The fourth slit 164 forms a seventh raw edge 177 and an eighth raw edge 178.

The first slit 161 is a cut formed in the second elastic tubular textile 122. The second slit 162 is a cut formed in the third elastic tubular textile 123. The third slit 163 is a cut formed in the fourth elastic tubular textile 124. The fourth slit 164 is a cut formed in the fifth elastic tubular textile 125.

The shirt 101 is worn by the wearer 210. The shirt 101 is the portion of the invention 100 that covers the torso 211, the left arm 212, and the right arm 213 of the wearer 210. The shirt 101 is assembled from the first elastic tubular textile 121, the second elastic tubular textile 122, the third elastic tubular textile 123, the first gusset 131, the second gusset 132, the first sub-plurality of gusset seams 134, and the second sub-plurality of gusset seams 135.

The pants 102 are worn by the wearer 210. The pants 102 are the portion of the invention 100 that covers the left leg 214 and the right leg 215 of the wearer 210. The pants 102 are assembled from the fourth elastic tubular textile 124, the fifth elastic tubular textile 125, the third gusset 133, the third sub-plurality of gusset seams 136, the first seam 141, the second seam 142, the third seam 143, and the fourth seam 144.

The hood 103 is worn by the wearer 210. The hood 103 is the portion of the invention 100 that covers the head 216 of the wearer 210. The hood 103 is assembled from the sixth elastic tubular textile 126 and the fifth seam 145.

The first arm opening 151, the second arm opening 152, and the head opening 153 are apertures formed in the first elastic tubular textile 121. The face opening 154 is an aperture formed in the sixth elastic tubular textile 126.

The first slit 161 is a cut formed in the third end 183 of the second elastic tubular textile 122. The second slit 162 is a cut formed in the fifth end 185 of the third elastic tubular textile 123. The third slit 163 is a cut formed in the seventh end 187 of the fourth elastic tubular textile 124. The fourth slit 164 is a cut formed in the ninth end 189 of the fifth elastic tubular textile 125.

The following two paragraphs describe the assembly of the invention 100.

The first sub-plurality of gusset seams 134 uses the first gusset 131 to attach the first raw edge 171 and the second raw edge 172 of the first slit 161 to the first arm opening 151 of the first elastic tubular textile 121. The second sub-plurality of gusset seams 135 uses the second gusset 132 to attach the third raw edge 173 and the fourth raw edge 174 of the second slit 162 to the second arm opening 152 of the first elastic tubular textile 121. The third sub-plurality of gusset seams 136 uses the third gusset 133 to attach the sixth raw edge 176 and the fifth raw edge 175 of the third slit 163 to the eighth raw edge 178 and the seventh raw edge 177 of the fourth slit 164 to form the crotch of the pants 102.

The first seam 141 attaches the fifth raw edge 175 of the third slit 163 to the sixth raw edge 176 of the fourth slit 164. The second seam 142 attaches the seventh raw edge 177 of the third slit 163 to the eighth raw edge 178 of the fourth slit 164. The third seam 143 closes the eighth end 188 of the fourth elastic tubular textile 124. The fourth seam 144 closes the tenth end 190 of the fifth elastic tubular textile 125. The fifth seam 145 closes the eleventh end 191 of the sixth elastic tubular textile 126.

This paragraph describes the steps to don the invention 100. The wearer 210 inserts the left arm 212, the right arm 213 and the head 216 into the second end 182 of the first elastic tubular textile 121. The right arm 213 inserts into the second elastic tubular textile 122 through the third end 183. The left arm 212 inserts into the third elastic tubular textile 123 through the fifth end 185. The head 216 inserts through the head opening 153 of the first elastic tubular textile 121. The right leg 215 inserts into the fourth elastic tubular textile 124 through the seventh end 187. The left leg 214 inserts into the fifth tubular elastic 125 through the ninth end 189. The head 216 inserts into the sixth elastic tubular textile 126 through the twelfth end 192.

The following definitions were used in this disclosure:

Bind: As used in this disclosure, to bind is a verb that means to tie or secure a first object to a second object using a cord or webbing.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Cylinder: As used in this disclosure, a cylinder is a geometric structure defined by two identical flat and parallel ends, also commonly referred to as bases, which are circular in shape and connected with a single curved surface, referred to in this disclosure as the lateral face. The cross-section of the cylinder remains the same from one end to another. The axis of the cylinder is formed by the straight line that connects the center of each of the two identical flat and parallel ends of the cylinder. Unless otherwise stated within this disclosure, the term cylinder specifically means a right cylinder which is defined as a cylinder wherein the curved surface perpendicularly intersects with the two identical flat and parallel ends.

Diameter: As used in this disclosure, a diameter of an object is a straight line segment (or a radial line) that passes through the center (or center axis) of an object. The line segment of the diameter terminates at the perimeter or boundary of the object through which the line segment of the diameter runs. A radius refers to the line segment that overlays a diameter with one termination at the center of the object. A span of a radius is always one half the span of the diameter.

Don: As used in this disclosure, to don means to put a garment on a person.

Elastic: As used in this disclosure, an elastic is a material or object that deforms when a force is applied to it and that is able to return to its relaxed shape after the force is removed. A material that exhibits these qualities is also referred to as an elastomeric material.

Elastic Textile: As used in this disclosure, an elastic textile is a textile that contains elastic yarns as some of the yarns that make up the textile. An elastic textile is constructed such that the elastic textile will stretch when a force is applied and will return to its original shape when after the force is removed.

Elastic Webbing: As used in this disclosure, an elastic webbing is a webbing that contains elastic yarns as some of the yarns that make up the webbing. An elastic webbing is constructed such that the elastic webbing will stretch when a force is applied and will return to its original shape when after the force is removed.

Elastic Yarn: As used in this disclosure, an elastic yarn is a yarn formed from elastomeric materials.

Hood: As used in this disclosure, a hood is a portion of an outerwear garment that is intended to cover the head and neck of the wearer with an opening for the face.

Mesh: As used in this disclosure, the term mesh refers to an openwork fabric made from threads, yarns, cords, wires, or lines that are woven, knotted, or otherwise twisted or intertwined at regular intervals. Synonyms for mesh include net.

Personal Protective Equipment: As used in this disclosure, personal protective equipment refers to the use of protective garments or protective equipment that is designed to protect the wearer's body from injury. Personal protective equipment may be designed for occupational protection, including, but not limited to, equipment to protect military, police, or firefighting personnel, or may be designed to provide protection in sports or recreational activities, including, but not limited to, equipment to protect participants in football, hockey, or soccer activities.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Radial: As used in this disclosure, the term radial refers to a direction that: 1) is perpendicular to an identified central axis; or, 2) projects away from a center point.

Raw Edges: As used in this disclosure, a raw edge refers to one of two edges formed when a textile is partially cut from the edge towards the center of the fabric. The end of the partial slit is called the termination point.

Relaxed Shape: As used in this disclosure, a structure is considered to be in its relaxed state when no shear, strain, or torsional forces are being applied to the structure.

Seam: As used in this disclosure, a seam is a joining of: 1) a first textile to a second textile; 2) a first sheeting to a second sheeting; or, 3) a first textile to a first sheeting. Potential methods to form seams include, but are not limited to, a sewn seam, a heat bonded seam, an ultrasonically bonded seam, or a seam formed using an adhesive.

Sewn Seam: As used in this disclosure, a sewn seam a method of attaching two or more layers of textile, leather, or other material through the use of a thread, a yarn, or a cord that is repeatedly inserted and looped through the two or more layers of textile, leather, or other material.

Sheath: As used in this disclosure, a sheath is a shell of material that is used to cover or enclose an object.

Slit: As used in this disclosure, a slit is a long narrow cut or opening formed in or through an object. See Raw Edge.

Spring: As used in this disclosure, a spring is a device that is used to store mechanical energy. This mechanical energy will often be stored by: 1) deforming an elastomeric material that is used to make the device; 2) the application of a torque to a rigid structure; or 3) a combination of the previous two items.

Tape: As used in this disclosure, tape refers to a flexible and narrow strip of textile or sheeting that fastens, secures, or strengthens an object.

Textile: As used in this disclosure, a textile is a material that is woven, knitted, braided or felted. Synonyms in common usage for this definition include fabric and cloth.

Tube: As used in this disclosure, the term tube is used to describe a hollow prism structure. The purpose of the tubes in this disclosure are structural. In this disclosure, the terms inner dimension and outer dimension of a tube are used as they would be used by those skilled in the plumbing arts.

Tubular Textile: As used in this disclosure, a tubular textile is a textile that is woven, knitted, or braided into a seamless tube-like shape.

Webbing: As used in this disclosure, a webbing is strong, close woven or knitted fabric that is used for straps or belting. As used in this disclosure, webbing is a fully formed material that is only cut to length for use. Webbing is not formed by cutting broader materials into strips.

Yarn: As used in this disclosure, a yarn is a continuous strand of textile fibers and filaments. Yarns are generally used in the production of fabrics. For the purposes of this disclosure, this definition explicitly includes yarns formed from a single filament such as a monofilament yarn.

With respect to the above description, it is to be realized that the optimum dimensional relationship for the various components of the invention described above and in FIGS. 1 through 4 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. An item of personal protective equipment comprising a plurality of tubular textiles, a plurality of gussets, a plurality of gusset seams, a plurality of seams, a plurality of openings, and a plurality of slits;

wherein the plurality of slits are cut in the plurality of tubular textiles;

wherein the plurality of openings are formed in the plurality of tubular textiles;

wherein the item of personal protective equipment is a protective garment kit;

wherein the item of personal protective equipment is configured to be donned by a wearer;

wherein the wearer is further defined with a torso, a left arm, a right arm, a left leg, a right leg, and a head;

wherein the plurality of gussets, the plurality of gusset seams, and the plurality of seams assemble the plurality of tubular textiles into a shirt, pants, and a hood that protect the wearer from an insect;

wherein the shirt, the pants, and the hood are formed from the plurality of tubular textiles;

wherein the plurality of tubular textiles are assembled into the item of personal protective equipment using the plurality of gussets, the plurality of gusset seams, the plurality of seams, and the plurality of slits;

wherein the plurality of tubular textiles comprises a first elastic tubular textile, a second elastic tubular textile, a third elastic tubular textile, a fourth elastic tubular textile and a fifth elastic tubular textile;

wherein the plurality of gussets comprises a first gusset, a second gusset, and a third gusset;

wherein the first gusset is a textile material cut to a previously specified shape;

wherein the second gusset is a textile material cut to a previously specified shape;

wherein the third gusset is a textile material cut to a previously specified shape;

wherein the first gusset widens the joint between the second elastic tubular textile to the first elastic tubular textile;

wherein the second gusset widens the joint between the third elastic tubular textile to the first elastic tubular textile;

wherein the third gusset widens the joint between the fourth elastic tubular textile to the fifth elastic tubular textile;

wherein the plurality of gusset seams comprises a first sub-plurality of gusset seams, a second sub-plurality of gusset seams, and a third sub-plurality of gusset seams;

wherein the first sub-plurality of gusset seams comprises a collection of sewn seams;

wherein the second sub-plurality of gusset seams comprises a collection of sewn seams;

wherein the third sub-plurality of gusset seams comprises a collection of sewn seams;

wherein the first sub-plurality of gusset attaches the first gusset, the second elastic tubular textile, and the first elastic tubular textile;

wherein the second sub-plurality of gusset seams attaches the second gusset, the third elastic tubular textile, and the first elastic tubular textile;

wherein the third sub-plurality of gusset seams attaches the third gusset the fourth elastic tubular textile and the fifth elastic tubular textile.

2. The item of personal protective equipment according to claim 1 wherein the item of personal protective equipment is formed as an elastic mesh structure;

wherein each of the plurality of tubular textiles is formed from an elastic mesh material;

wherein the elastic mesh structure of the item of personal protective equipment forms a fluid permeable barrier around the wearer;

wherein the elastic mesh structure of the item of personal protective equipment forms a barrier structure around the wearer that prevents an insect from directly contacting the skin of the wearer;

wherein the elastic mesh material is a textile mesh formed from both elastic and inelastic yarns.

3. The item of personal protective equipment according to claim 2 wherein the first elastic tubular textile is further defined with a first end and a second end;

wherein the second elastic tubular textile is further defined with a third end and a fourth end;

wherein the third elastic tubular textile is further defined with a fifth end and a sixth end;

wherein the first elastic tubular textile is a tubular elastic formed from the elastic mesh material;

wherein the second elastic tubular textile is a tubular elastic formed from the elastic mesh material;

wherein the third elastic tubular textile is a tubular elastic formed from the elastic mesh material;

wherein the first elastic tubular textile protects the torso of the wearer from an insect;

wherein the second elastic tubular textile protects the right arm of the wearer from an insect;

wherein the third elastic tubular textile protects the left arm of the wearer from an insect.

4. The item of personal protective equipment according to claim 3 wherein the fourth elastic tubular textile is further defined with a seventh end and an eighth end;

wherein the fifth elastic tubular textile is further defined with a ninth end and a tenth end;

wherein the fourth elastic tubular textile is a tubular elastic formed from the elastic mesh material;

wherein the fifth elastic tubular textile is a tubular elastic formed from the elastic mesh material;

wherein the fourth elastic tubular textile protects the right leg of the wearer from an insect;

wherein the fifth elastic tubular textile protects the left leg of the wearer from an insect.

5. The item of personal protective equipment according to claim 4 wherein the plurality of tubular textiles further comprises a sixth elastic tubular textile;

wherein the sixth elastic tubular textile is further defined with an eleventh end and a twelfth end;

wherein the sixth elastic tubular textile is a tubular elastic formed from the elastic mesh material;

wherein the sixth elastic tubular textile protects the head of the wearer from an insect.

6. The item of personal protective equipment according to claim 5 wherein each of the plurality of gussets is a textile material;

wherein each of the plurality of gussets is used to widen a sub-plurality of gusset seams selected from the plurality of gusset seams.

7. The item of personal protective equipment according to claim 6 wherein each of the plurality of gusset seams comprises a sub-plurality of sewn seams that joins two tubular textiles selected from the plurality of tubular textiles.

8. The item of personal protective equipment according to claim 7 wherein each of the plurality of seams is a sewn seam;

wherein each of the plurality of seams make an attachment selected from the group consisting of a) attaching a first tubular textile selected from the plurality of tubular textiles to a second tubular textile selected from the plurality of tubular textiles; and, b) closing the end of a tubular textile selected from the plurality of tubular textiles.

9. The item of personal protective equipment according to claim 8 wherein the plurality of seams comprises a first seam, a second seam, a third seam, a fourth seam, and a fifth seam;

wherein the first seam is a seam used in the assembly of the pants;

wherein the second seam is a seam used in the assembly of the pants;

wherein the third seam is a seam used in the assembly of the pants;

wherein the fourth seam is a seam used in the assembly of the pants;

wherein the fifth seam is a seam used in the assembly of the hood.

10. The item of personal protective equipment according to claim 9 wherein the plurality of openings comprises a first arm opening, a second arm opening, a head opening, and a face opening;

wherein the first arm opening is an aperture in the first elastic tubular textile;

wherein the second arm opening is an aperture in the first elastic tubular textile;

wherein the head opening is an aperture in the first elastic tubular textile;

wherein the face opening is an aperture in the sixth elastic tubular textile;

wherein the first arm opening receives the right arm of the wearer;

wherein the second arm opening receives the left arm of the wearer;

wherein the head opening receives the head of the wearer;

wherein the head opening is formed at the first end of the first elastic tubular textile.

11. The item of personal protective equipment according to claim 10 wherein each of the plurality of slits is a cut formed in a tubular textile selected from the plurality of tubular textiles;

wherein each of the plurality of slits starts at the edge of an end of a selected tubular textile;

wherein each of the plurality of slits has a termination point within the face of the selected tubular textile;

wherein the plurality of slits comprises a first slit, a second slit, a third slit, and a fourth slit;

wherein the first slit forms a first raw edge and a second raw edge;

wherein the second slit forms a third raw edge and a fourth raw edge;

wherein the third slit forms a fifth raw edge and a sixth raw edge;

wherein the fourth slit forms a seventh raw edge and an eighth raw edge.

12. The item of personal protective equipment according to claim 11 wherein the first slit is a cut formed in the third end of the second elastic tubular textile;

wherein the second slit is a cut formed in the fifth end of the third elastic tubular textile;

wherein the third slit is a cut formed in the seventh end of the fourth elastic tubular textile;

wherein the fourth slit is a cut formed in the ninth end of the fifth elastic tubular textile.

13. The item of personal protective equipment according to claim 12 wherein the shirt is assembled from the first elastic tubular textile, the second elastic tubular textile, the third elastic tubular textile, the first gusset, the second gusset, the first sub-plurality of gusset seams, and the second sub-plurality of gusset seams;

wherein the pants are assembled from the fourth elastic tubular textile, the fifth elastic tubular textile, the third gusset, the third sub-plurality of gusset seams, the first seam, the second seam, the third seam, and the fourth seam;

wherein the hood is assembled from the sixth elastic tubular textile and the fifth seam.

14. The item of personal protective equipment according to claim 13 wherein the first sub-plurality of gusset seams uses the first gusset to attach the first raw edge and the second raw edge of the first slit to the first arm opening of the first elastic tubular textile;

wherein the second sub-plurality of gusset seams uses the second gusset to attach the third raw edge and the fourth raw edge of the second slit to the second arm opening of the first elastic tubular textile;

wherein the third sub-plurality of gusset seams uses the third gusset to attach the sixth raw edge and the fifth raw edge of the third slit to the eighth raw edge and the seventh raw edge of the fourth slit to form the pants;

wherein the first seam attaches the fifth raw edge of the third slit to the sixth raw edge of the fourth slit;

wherein the second seam attaches the seventh raw edge of the third slit to the eighth raw edge of the fourth slit;

wherein the third seam closes the eighth end of the fourth elastic tubular textile;

wherein the fourth seam closes the tenth end of the fifth elastic tubular textile;

wherein the fifth seam closes the eleventh end of the sixth elastic tubular textile.

15. The item of personal protective equipment according to claim 14 wherein in the first potential embodiment of the disclosure, the elastic mesh material is formed from elastic spandex yarns and inelastic yarns selected from the group consisting of nylon yarns and polyester yarns.

* * * * *